US005854185A

United States Patent [19]

Roth et al.

[11] Patent Number: 5,854,185

[45] Date of Patent: Dec. 29, 1998

[54] LUBRICANT MIXTURES AND GREASE COMPOSITIONS BASED THEREON

[75] Inventors: Robert John Gordon Roth; Georgina Ann Winterburn, both of Ontario, Canada

[73] Assignee: Shell Oil Company, Houston, Tex.

[21] Appl. No.: 977,970

[22] Filed: Nov. 25, 1997

Related U.S. Application Data

[63] Continuation-in-part of Ser. No. 692,562, Aug. 6, 1996, abandoned, which is a continuation of Ser. No. 413,143, Mar. 29, 1995, abandoned.

[30] Foreign Application Priority Data

Mar. 31, 1994 [EP] European Pat. Off. ..... 943023721

[51] Int. Cl.[6] ..... C10M 105/32; C10M 111/04

[52] U.S. Cl. ..... 508/492; 508/136; 508/496; 508/591

[58] Field of Search ..... 508/492

[56] References Cited

U.S. PATENT DOCUMENTS

| | | | |
|---|---|---|---|
| 3,382,291 | 5/1968 | Brennan | 260/683.15 |
| 3,742,082 | 6/1973 | Brennan | 260/683.9 |
| 3,769,363 | 10/1973 | Brennan | 260/683.15 |
| 3,860,522 | 1/1975 | Fischer et al. | 252/56 |
| 4,175,046 | 11/1979 | Coant et al. | 252/56 |
| 4,406,800 | 9/1983 | Christian | 252/28 |
| 4,589,990 | 5/1986 | Zehler et al. | 252/56 |
| 4,601,840 | 7/1986 | Zehler et al. | 252/56 |
| 4,749,502 | 6/1988 | Alexander et al. | 252/35 |
| 4,859,352 | 8/1989 | Waynick | 252/41 |
| 4,879,054 | 11/1989 | Waynick | 252/41 |
| 4,956,122 | 9/1990 | Watts et al. | 252/565 |
| 4,968,453 | 11/1990 | Wada et al. | 252/56 |
| 5,085,792 | 2/1992 | Narihiko et al. | 252/79 |
| 5,190,682 | 3/1993 | Harris | 252/56 |
| 5,358,650 | 10/1994 | Srinivasan et al. | 252/45 |
| 5,364,544 | 11/1994 | Otake et al. | 252/28 |
| 5,382,374 | 1/1995 | Takemitsu et al. | 252/73 |
| 5,391,312 | 2/1995 | Senaratne et al. | 252/56 |
| 5,714,444 | 2/1998 | Yokouchi et al. | 508/539 |

FOREIGN PATENT DOCUMENTS

89/12672 12/1989 WIPO .

OTHER PUBLICATIONS

Symposia Section, "Chemistry of Synthetic Lubricants and Additives", H. V. Lowther, 178$^{th}$ National Meeting of the American Chemical Society, Washington, D.C., Sep. 1979, Wide–Temperature Range Synthetic Hydrocarbon Fluids. Ind. Eng. Chem. Prod. Dev. 1980, pp. 2–6.

"Lubrication and Lubricants", vol. 14, pp. 477–526.

*Primary Examiner*—Ellen M. McAvoy

[57] ABSTRACT

The present invention provides lubricant mixtures for use as base fluid in bearing grease comprising 25 to 90 percent w/w of a liquid ester having a viscosity at 40° C. in the range 100 to 200 $mm^2/s$, and 75 to 10 percent w/w of a liquid poly-α-olefin having a viscosity at 100° C. in the range 2 to 10 $mm^2/s$, and bearing grease compositions containing a major proportion of such lubricant mixtures, particularly such compositions containing a clay thickener.

15 Claims, No Drawings

LUBRICANT MIXTURES AND GREASE COMPOSITIONS BASED THEREON

This is a Continuation-In-Part of application Ser. No. 08/692,562, filed Aug. 6, 1996, now abandoned, which is a Continuation of application Ser. No. 08/413,143, filed Mar. 29, 1995 now abandoned.

FIELD OF THE INVENTION

The present invention relates to lubricant mixtures and to grease compositions based thereon, particularly multipurpose bearing grease compositions.

DESCRIPTION OF THE PRIOR ART

WO 89/12672 (Mobil) discloses lubricant compositions comprising (a) a major amount of low viscosity $C_{20-60}$ lubricant range liquid comprising substantially linear hydrocarbons prepared by shape-selective catalysis of lower olefin with medium pore acid zeolite catalyst to provide substantially inert liquid olefinic intermediates or $C_{20+}$ hydrogenated lubricants, the lubricant range liquid having a kinematic viscosity of 2 to 10 $mm^2/s$ at 100° C., and (b) a minor amount of at least one poly-α-olefin having a viscosity of at least 20 $mm^2/s$ at 100° C. and viscosity index improvement properties.

In the introductory part of WO 89/12672, discussing the prior art, it is stated that synthetic poly-α-olefins (PAO), such as 1-decene oligomers, have found wide acceptability and commercial success in the lubricant field for their superiority to mineral oil based lubricants. In terms of lubricant properties improvement, industrial research effort on synthetic lubricants has led to PAO fluids exhibiting useful viscosities over a wide range of temperature, i.e., improved viscosity index (VI), while also showing lubricity, thermal and oxidative stability and pour point equal to or better than mineral oil. These relatively new synthetic lubricants lower mechanical friction, enhancing mechanical efficiency over the full spectrum of mechanical loads from worn gears to traction drives, and do so over a wider range of ambient operating conditions than mineral oil.

PAO's are prepared by the polymerization of 1-alkenes using typically Lewis acid or Ziegler catalysts. Their preparation properties are described by J. Brennan in Ind. Eng. Chem. Prod. Res. Dev. 1980, 19, pp. 2–6. PAO incorporating improved lubricant properties are also described by J. A. Brennan in U.S. Pat. Nos. 3,382,291, 3,742,082, and 3,769,363.

In accordance with customer practice in the lubricants art, PAO's have been blended with a variety of functional chemicals, oligomeric and high polymers and other synthetic and mineral oil-based lubricants to confer or improve upon lubricant properties necessary for applications such as engine lubricants, hydraulic fluids, gear lubricants, etc. Blends and their components are described in Kirk-Othmer Encyclopedia of Chemical Technology, third edition, volume 14, pp. 477–526.

A particular goal in the formulation of blends is the enhancement of viscosity index (VI) by the addition of VI improvers which are typically high molecular weight synthetic organic molecules. While effective in improving viscosity index, these VI improvers have been found to be deficient in that their very property of high molecular weight, which makes them useful as VI improvers, also confers upon the blend a vulnerability in shear stability during actual use applications.

It is known to incorporate a chlorinated solvent, e.g., 1,1,1-trichloroethane, in order to facilitate the low temperature mobility of a lubricant (to assist pumping thereof), e.g. for cold climates such as Canada or northern Europe. Once the lubricant is in place, the chlorinated solvent evaporates off. Since chlorinated solvents such as 1,1,1-trichloroethane have been implicated in ozone depletion of the earth's upper atmosphere, avoidance of their use would be advantageous.

U.S. Pat. No. 5,190,682 discloses a lubricant mixture comprising a low viscosity PAO and a highly branched polybutene. Grease components incorporating this mixture have good mechanical stability and extreme pressure (EP) properties, and good low temperature mobility. It would, however, be desirable to provide a grease having improved low temperature mobility to this.

It has now surprisingly been found that blends of certain low-viscosity poly-α-olefins and certain high viscosity esters are very effective lubricant mixtures for use as base fluids for bearing greases.

SUMMARY OF THE INVENTION

The present invention is a lubricant mixture suitable for use as base fluid in bearing grease which comprises 25 to 90 percent w/w of a liquid ester having a viscosity at 40° C. in the range 100 to 200 $mm^2/s$, and 75 to 10 percent w/w of a liquid poly-α-olefin having a viscosity at 100° C. in the range 2 to 10 $mm^2/s$.

DESCRIPTION OF THE PREFERRED EMBODIMENTS

Greases incorporating the lubricant mixture of the invention provide adequate lubrication at high temperatures, but in addition can be dispensed and provide lubrication at very low temperatures, for example down to −45° C. Such greases have good mechanical stability, improved resistance to water, and surprisingly good EP properties. They are particularly suitable for use in heavy duty industrial applications where extremely high or low operating temperatures are encountered, for example, in large earth moving equipment with centralized lubrication systems, operating in low temperatures.

Preferably the lubricant mixture comprises 50 percent to 90 percent w/w of the ester and 50 percent to 10 percent w/w of the poly-α-olefin, more preferably 70 percent to 90 percent w/w of the ester and 30 percent to 10 percent w/w, e.g. 25 to 35 percent w/w of the poly-α-olefin.

Esters having the required viscosity characteristics are known materials, e.g., the esters sold under the trademarks "Emery 2905" and "Uniflex 103". The ester used in the invention has a viscosity at 40° C. in the range 100 to 200 $mm^2/s$, preferably in the range 130 to 170 $mm^2/s$, and more preferably in the range of 145 to 155 $mm^2/s$, measured by ASTM D-445.

Poly-α-olefins having the required viscosity characteristics are also known materials, e.g. that sold under the trade designation "PAO 4 cSt." The poly-α-olefin has a viscosity at 100° C. in the range 2 to 10 $mm^2/s$, preferably 4 to 6 $mm^2/s$, measured by ASTM D-445.

The invention further provides a bearing grease composition which comprises a major proportion of a lubricant mixture of the invention as defined above, in admixture with a thickener and at least one additional component selected from solid lubricants, extreme pressure additives, stabilizers, anti-oxidants, and anti-corrosion additives.

Clay thickeners are particularly suitable, e.g. hectorite- or bentonite-derived clay thickeners, preferably hectorite clay thickeners, e.g. in amounts in the range 2 to 10 percent by weight, preferably 2 to 6 percent by weight of the grease composition. A clay activator may be added in a small amount, e.g. 0.1 to 0.5 percent by weight of the grease composition, or a clay coating agent may be added in a small amount, e.g., 0.5 to 3.0% by weight of the grease. Suitable clay coating agents include partially amidized polyamines and hydrogenated tallow amines.

Additional components may be present in amounts in the range 0.1 to 20 percent by weight, although the total amount of such components plus thickener will constitute less than 50 percent weight of the grease composition.

Extreme pressure additives include lead naphthenate, other organic metal salts, sulfurized fatty oils, other sulfurized organic compounds, graphite, molybdenum disulphide, carbon black, and castor oil. Glycerol may be incorporated as enhancer for extreme pressure additives.

Anti-corrosion additives include nitrites such as sodium nitrite, organic metal salts, sulfurized fatty oils and succinic acid derivatives. Anti-oxidants include phenothiazines such as N-benzyl-phenothiazine, phenolic compounds, aromatic amines, organic metal salts, and sulfurized fatty oils.

Mixtures of such additives, as well as other well-known additives may be used.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following example which is provided for illustrative purposes and is not to be construed as limiting the invention.

EXAMPLE

A grease was prepared according to the following formulation:

| Component | % by Weight |
|---|---|
| PAO 4 | 13.91 |
| "Emery 2905" (trademark) | 70.37 |
| Hectorite Clay Thickener | 5.30 |
| "Alkamide 1334" (trademark) | 0.67 |
| DMHTD | 1.56 |
| Lard Oil | 1.56 |
| Phosphoric Acid (85%) | 0.67 |
| "Epon 828" (trademark) | 2.86 |
| "Vanlube 8610" (trademark) | 2.00 |
| "Vanlube RIA" (trademark) | 0.60 |
| "Epolene C-16" (trademark) | 0.30 |
| "Naugalube 438L" (trademark) | 0.20 |

PAO 4 is a poly-α-olefin having a viscosity at 100° C. of 4 $mm^2/s$ (ASTM D-445).

"Emery 2905" is a mixed ester of a $C_{36}$ dicarboxylic acid, 2-ethylhexanol and neopentyl glycol, having a viscosity at 40° C. of 150 $mm^2/s$ (ASTM D-445).

"Alkamide 1334" is a partially amidized polyamine derived from tall oil fatty acids.

DMHTD is a hydrogenated tallow amine.

"Epon 828" is an epoxide resin.

"Vanlube 8610" is a blend of metallic dialkyldithiocarbonateand sulfurized olefin.

"Vanlube RIA" is an alkyl succinic acid derivative.

"Epolene C-16" is a low molecular weight functionalized polyethylene.

"Naugalube 428L" is diphenylamine.

The "Emery 2905" and PAO 4 $mm^2/s$ were blended together (in weight proportion~80:20) to give a base oil blend having a viscosity of 100 $mm^2/s$ at 40° C. and a VI of 153.

40 percent by weight of the resulting base oil blend and the clay were stirred together at 50° C. for 20 minutes in a Hobart grease kettle, and the resulting mixture was passed once through a three-roll mill.

To this mixture were then added the remaining additives and stirring was continued at 80° C. for 20 minutes, after which the remaining 60 percent by weight of the based oil blend was added with stirring until a homogeneous grease was obtained.

The resulting grease was subjected to the following tests: Four Ball EP Weld Load test (ASTM D 2596), Four Ball Wear Scar test (ASTM D 2266), Mobility test (US Steel DM 43), Low Temperature Torque at −40° C. (ASTM D 4693) Evaporation Loss, 22 hours at 150° C. (ASTM D 2595) and Water Washout (ASTM D 1264). A commercially available grease "Esso Epil 102" was subjected to the same tests for comparison purposes. Results are given in Table I below, where the grease of the present invention is identified as "Example" and the grease "Esso Epic 102" is identified as "Comp.".

TABLE I

| Text | Example | Comp. |
|---|---|---|
| 4-Ball EP Weld Load (kg) | 400 | 250 |
| 4-Ball Wear Scar diameter (mm) | 0.59 | 0.43 |
| Mobility at −40° C. (g/min) | 3.3 | 1.7 |
| Low Temp. Torque at −40° C. (N.m) | 0.5 | 1.0 |
| Evaporation Loss (% wt) | 2.0 | 15.0 |
| Water Washout (% wt) | 2.7 | 15.0 |

It can be seen from these results that the Example of the present invention exhibits greatly superior performance characteristics.

What is claimed is:

1. A lubricant mixture suitable for use as base fluid in bearing grease, the mixture comprising from about 25 to about 90 percent w/w of a liquid ester having a viscosity at 40° C. in the range of about 100 $mm^2/s$ to about 200 $mm^2/s$ and from about 75 percent to about 10 percent w/w of a liquid poly-α-olefin having a viscosity at 100° C. in the range of about 2 $mm^2/s$ to about 10 $mm^2/s$.

2. The mixture of claim 1 wherein said ester is present in an amount from about 50 percent to about 90 percent w/w and said poly-α-olefin is present in an amount from about 50 percent to about 10 percent w/w.

3. The mixture of claim 1 wherein said ester is present in an amount from about 70 percent to about 90 percent w/w and said poly-α-olefin is present in an amount from about 30 percent to about 10 percent w/w.

4. The mixture of claim 2 wherein the viscosity of the ester at 40° C. is in the range of about 130 $mm^2/s$ to about 170 $mm^2/s$.

5. The mixture of claim 4 wherein the viscosity of the ester at 40° C. is in the range of about 145 $mm^2/s$ to about 155 $mm^2/s$.

6. The mixture of claim 2 wherein the viscosity of the poly-α-olefin at 100° C. is in the range of about 4 to about 6 $mm^2/s$.

7. The mixture of claim 1 wherein the ester is a mixed ester of a $C_{36}$ dicarboxylic acid, 2-ethylhexanol and neopentyl glycol.

8. A bearing grease composition which comprises a major amount of a lubricant mixture comprising from about 25 percent to about 90 percent w/w of a liquid ester having a viscosity at 40° C. in the range of about 100 $mm^2/s$ to about 200 $mm^2/s$ and from about 75 percent to about 10 percent w/w of a liquid poly-α-olefin having a viscosity at 100° C. in the range of about 2 $mm^2/s$ to about 10 $mm^2/s$ in admixture with a thickener and at least one additional component selected from solid lubricants, extreme pressure additives, stabilizers, anti-oxidants and anti-corrosion additives.

9. The mixture of claim 8 wherein said ester is present in an amount from about 50 percent to about 90 percent w/w and said poly-α-olefin is present in an amount from about 50 percent to about 10 percent w/w.

10. The mixture of claim 8 wherein said ester is present in an amount from about 70 percent to about 90 percent w/w and said poly-α-olefin is present in an amount from about 30 percent to about 10 percent w/w.

11. The mixture of claim 9 wherein the viscosity of the ester at 40° C. is in the range of about 130 $mm^2/s$ to about 170 $mm^2/s$.

12. The mixture of claim 11 wherein the viscosity of the ester at 40° C. is in the range of about 145 $mm^2/s$ to about 155 $mm^2/s$.

13. The mixture of claim 9 wherein the viscosity of the poly-α-olefin at 100 ° C. is in the range of about 4 to about 6 $mm^2/s$.

14. The bearing grease composition of claim 8 wherein the thickener is a clay thickener.

15. The bearing grease composition of claim 14 wherein the clay thickener is a hectorite clay.

* * * * *